US012636698B2

(12) United States Patent
Gebel

(10) Patent No.: US 12,636,698 B2
(45) Date of Patent: May 26, 2026

(54) MANUFACTURING SYSTEM

(71) Applicant: TUSAS—TURK HAVACILIK VE UZAY SANAYII ANONIM SIRKETI, Ankara (TR)

(72) Inventor: Muhammed Enes Gebel, Ankara (TR)

(73) Assignee: TUSAS—TURK HAVACILIK VE UZAY SANAYII ANONIM SIRKETI, Ankara (TR)

( * ) Notice: Subject to any disclaimer, the term of this patent is extended or adjusted under 35 U.S.C. 154(b) by 268 days.

(21) Appl. No.: 18/533,976

(22) Filed: Dec. 8, 2023

(65) Prior Publication Data

US 2024/0198412 A1 Jun. 20, 2024

(30) Foreign Application Priority Data

Dec. 20, 2022 (TR) ..... 2022/019821

(51) Int. Cl.
*B21J 9/20* (2006.01)
*B21J 9/02* (2006.01)
*B21J 9/18* (2006.01)

(52) U.S. Cl.
CPC . *B21J 9/20* (2013.01); *B21J 9/02* (2013.01); *B21J 9/18* (2013.01)

(58) Field of Classification Search
CPC ..... B21J 1/05; B21J 5/002; B21J 9/02; B21J 9/18; B21J 9/20; B21J 1/06
See application file for complete search history.

(56) References Cited

U.S. PATENT DOCUMENTS

| | | | | |
|---|---|---|---|---|
| 9,987,707 | B2 * | 6/2018 | Dong | B22F 10/25 |
| 11,110,513 | B2 | 9/2021 | Jiang et al. | |
| 11,945,032 | B2 * | 4/2024 | Chang | B33Y 40/00 |
| 2017/0326681 | A1 * | 11/2017 | Sidhu | B23P 9/04 |
| 2022/0324047 | A1 * | 10/2022 | Mruczek | B23K 37/0452 |
| 2024/0009770 | A1 * | 1/2024 | Wilson | B22F 12/37 |
| 2024/0238870 | A1 * | 7/2024 | Andersson | B33Y 40/20 |

FOREIGN PATENT DOCUMENTS

CN 110744172 B 2/2020

OTHER PUBLICATIONS

CN 104625656A, Yan et al. May 2015.*
(Continued)

*Primary Examiner* — Edward T Tolan
(74) *Attorney, Agent, or Firm* — Notaro, Michalos & Zaccaria P.C.

(57) ABSTRACT

At least one device enables the implementation of a metal additive manufacturing method. At least one raw material is in the metal additive manufacturing method. A feeder is located on the device and enables the raw material to be deposited. A heat source is located on the device and enables the raw material from the feeder to be melted. A table enables the raw material to be processed thereon. A part is formed by melting and processing the raw material on the table using the heat source. A forging element provides improvement in the micro- and/or macrostructure of the part by exerting force on the part under the control of a user and/or automatically. A base is provided on which the device is located. A control unit enables the position of the table to be changed with respect to the base.

12 Claims, 1 Drawing Sheet

(56) References Cited

OTHER PUBLICATIONS

Translation CN 104625656A, Yan et al. May 2015.*
CN 110744303A, Liu et al. Feb. 2020.*
Translation CN 110744303A, Liu et al. Feb. 2020.*
CN 113020626A, Zhang et al. Jun. 2021.*
CN 110552003A, Xi et al. Dec. 2019.*
CN 106825348A, Suo et al. Jun. 2017.*

* cited by examiner

MANUFACTURING SYSTEM

CROSS-REFERENCE TO RELATED APPLICATIONS

This patent application claims the benefit and priority of Turkish Patent Application No. 2022/019821, filed on Dec. 20, 2022, the disclosure of which is incorporated by reference herein in its entirety as part of the present disclosure.

FIELD

The present invention relates to a metal additive manufacturing system forging method.

BACKGROUND

The use of additive manufacturing together with metal powders is a developing industry. Directed energy deposition systems include arc, plasma, laser or electron beam energy forms and metal deposition systems in which a part is obtained by melting a consumable material in the form of wire and/or powder side by side and on top of each other, or other systems in which a molten pool is formed by melting a metal using plasma induction heating. The metal additive manufacturing process requires a complex metallurgical process, wherein the melting, solidification and cooling of the material during the shaping of parts occur rapidly in a short time, so grain size and porosity are important problems in large-scale complex metal components and structural elements produced by means of metal additive manufacturing. One of the methods put forward to solve this problem is hot/cold forging.

The United States patent document U.S. Pat. No. 11,110,513B2, which is included in the known state of the art, describes ultrasonic micro forging device combined to improve the microstructure and mechanical properties of a metal part manufactured with additive, which can solve the problems related to defects, coarse particles and weak mechanical properties of a component part. A small diameter roller achieves rolling and forging effects when it is continuously rolled over each deposition layer created during an additive manufacturing process. At the same time, an ultrasonic wave energy acts directly on the deposition layer with the small diameter cylinder effect.

In the People's Republic of China patent document CN110744172B, which is included in the known state of the art, since the forging surfaces of the first forging head are arranged symmetrically on four sides of the forging part, the first forging head is able to forge the coating layer in real-time in the process of moving back and forth along the path of the coating layer formed by the coating layer.

SUMMARY

Thanks to a manufacturing system developed by this invention, it is ensured that forging is performed spatially during the manufacturing of parts by metal additive manufacturing.

One object of this invention is to provide a more homogeneous distribution in mechanical and metallurgical properties by exerting a force both from below and above a part during the manufacturing thereof in a metal additive manufacturing.

Another object of this invention is to effectively improve a part's particle shrinkage and porosity.

The manufacturing system realized to achieve the object of the invention, defined in the first claim and in the claims dependent thereon, comprises at least one device in which metal additive manufacturing is performed. The device contains the raw material required to manufacture the part. The raw material is deposited on a table by means of a feeder. The raw material is melted on the table by means of a heat source. As a result of melting and processing the raw material by means of the heat source, parts are manufactured. A forging element exerts force on the part as controlled by the user and/or automatically, thereby providing improvement in the micro- and/or macrostructure of the part. The device is located on a base. A control unit enables the position of the table to be changed concerning the base and the part to be processed in different orientations.

The forging element is located opposite the device on the ground in the manufacturing system according to the present invention. A forging surface is arranged on the forging element, enables force to be exerted onto the part. A sliding mechanism located on the base enables at least one of the devices and/or the forging element to move to get closer to the other. The control unit rotates around a point at which the table is connected to the device, enabling it to stay opposite the forging surface and the forging element to have the forging surface forge the part using the sliding mechanism.

In an embodiment of the invention, the manufacturing system comprises at least one support element extending between the base and the table. The table can be connected to the support element by means of a connection point. At least one support leg is provided, extending between the base and the forging surface. The forging surface can be connected to the support leg thanks to a pivot point. The control unit enables the forging surface to rotate around the pivot point with respect to the base and the table to rotate around the pivot point with respect to the base so that the table and the forging surface stay opposite to each other. The part is fixed on the table so that the part does not fall off the table during the manufacturing and forging process.

In an embodiment of the invention, the control unit enables the table to rotate around the connection point so as to become almost perpendicular to the base such that it stays opposite the forging surface.

In an embodiment of the invention, the manufacturing system comprises at least one first transmission element preferably in the form of a spring, the element being located on the table and enabling a force exerted on it to be transferred to the part. At least one second transmission element preferably in the form of a spring is located on the forging element, enabling a force exerted on it to be transferred to the part. One of the table and/or forging surfaces is moved close to the other one by means of the sliding mechanism so that the part stays between the table and the forging surface. The control unit ensures that the first transmission element and the second transmission element are energized so that the force is distributed more evenly throughout the part's surface.

In an embodiment of the invention, a table substrate is located between the table and the support element. The first transmission element is located between the table and the table substrate. Under the control of the control unit, the first transmission element is energized by means of a first actuator, whereby the first transmission element exerts a force to the tray. A forging substrate is located between the forging surface and the support leg. The second transmission element is located between the forging surface and the forging substrate. Under the control of the control unit, the second transmission element is energized by means of a second actuator, whereby the second transmission element exerts a force to the forging surface.

In an embodiment of the invention, the forging surface has mirror symmetry with respect to the table so that the part stays between the table and the forging surface.

In an embodiment of the invention, the forging surface has a larger cross-section than the part, whereby it performs forging on almost the entirety of the part at the same time.

In an embodiment of the invention, a sensor is located on the forging surface so that when the forging surface comes into contact with the part, it transmits this information to the control unit. The control unit enables the movement of the table and/or the forging surface on the sliding mechanism to be stopped when the part stays between the table and the forging surface.

In an embodiment of the invention, a rotary element is located between the table substrate and the support element, thereby enabling the table to rotate around its axis while the part is manufactured on the table.

In an embodiment of the invention, the control unit enables the forging surface to automatically exert force on the part at user-determined layer number breaks.

In an embodiment of the invention, the forging surface is manufactured to be almost form-fitting to the part, so that the form of the first layer deposited on the table will not change and the part produced in layers will be form-fitting to itself.

In an embodiment of the invention, the part is produced directly by the energy deposition method.

BRIEF DESCRIPTION OF THE DRAWINGS

The manufacturing system realized to achieve the object of the present invention is illustrated in the attached figures, wherein from these figures.

Figure 1:
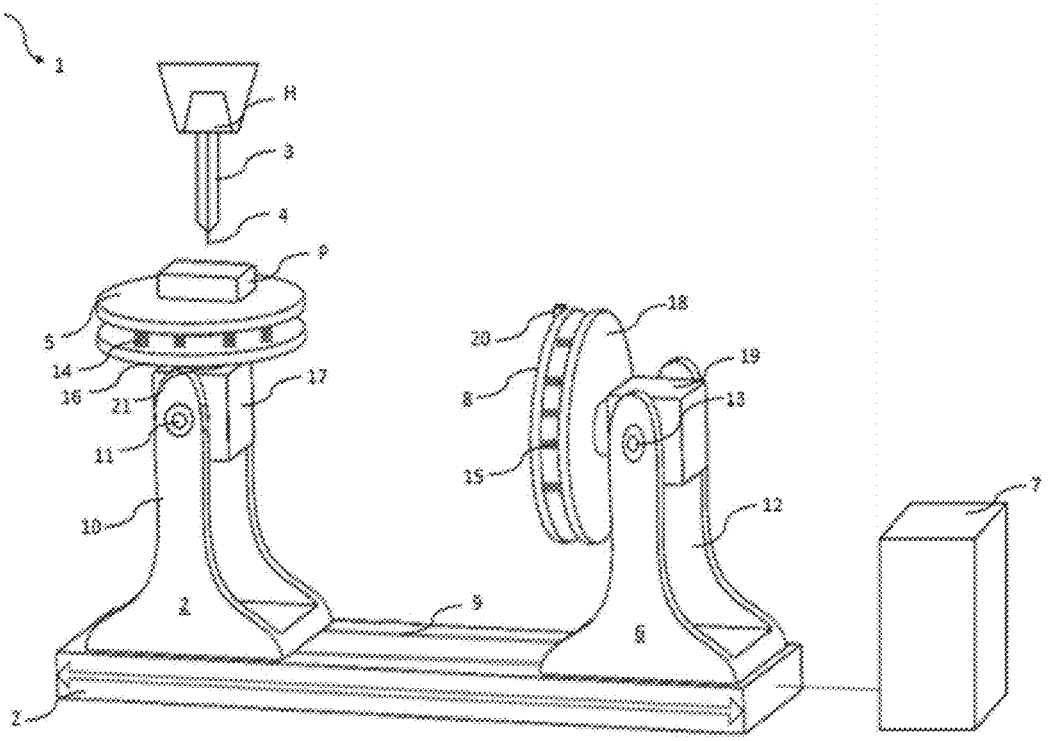
FIG. 1 is a schematic view of the manufacturing system.

The parts illustrated in figures are individually assigned a reference numeral and the corresponding terms of these numerals are listed below.

1. Manufacturing system
2. Device
3. Feeder
4. Heat source
5. Table
6. Forging element
7. Control element
8. Forging surface
9. Sliding mechanism
10. Support element
11. Connection point
12. Support leg
13. Pivot point
14. First transmission element
15. Second transmission element
16. Table substrate
17. First actuator
18. Forging substrate
19. Second actuator
20. Sensor
21. Rotary element
P. Part
H. Raw material
Z. Base

DETAILED DESCRIPTION

At least one device (2) enabling the implementation of a metal additive manufacturing method comprises at least one raw material (H) suitable for use in the metal additive manufacturing method, at least one feeder (3) located on the device (2) and enabling the raw material (H) to be deposited, at least one heat source (4) located on the device (2) and enabling the raw material (H) from the feeder (3) to be melted, at least one table (5) enabling the raw material (H) to be processed thereon, at least one part (P) formed by melting and processing the raw material (H) on the table (5) by means of the heat source (4), at least one forging element (6) providing improvement in the micro- and/or macrostructure of the part (P) by exerting force on the part (P) under the control of a user and/or automatically, a base (Z) on which the device (2) is located, at least one control unit (7) enabling the position of the table (5) to be changed with respect to the base (Z).

In the manufacturing system (1) according to the invention, the forging element (6) is located opposite the device (2) on the base (Z), at least one forging surface (8) is located on the forging element (6), enabling the part (P) to be forged, at least one sliding mechanism (9) is located on the base (Z), enabling at least one of the device (5) and/or the forging element (6) to move close to the other one, and the control unit (7) enables the table (5) to stay opposite the forging surface (8) by being rotated around the point at which it is connected to the device (2) and the forging element (6) to be moved by means of the sliding mechanism (9) so that the forging surface (8) exerts force on the part (P).

The device for implementing a metal additive manufacturing method contains raw material (H) for the manufacture of parts (P) by means of the metal additive manufacturing method. The feeder (3) enables the raw material (H) to be deposited on the table (5). The heat source enables the raw material (H) to be melted and processed on the table. Grain size and/or porosity problems possibly occurring on the part (P) are improved in the micro- and/or macro dimension of the part (P) by the forging element (6) applying force on the part (P).

The forging element (6) is located on the same base (Z) and the same sliding mechanism (9) as the device (2) so as to face the device (2). The forging surface (8) is located on the forging element (6) so as to stay opposite the table (5), enabling the part (P) to be forged. The control unit (7) enables the table (5) to be rotated around the point at which it is connected to the device so as to stay opposite the forging surface (8) and the forging element (6) to be slid towards the device (2) by means of the sliding mechanism (9) so that the forging surface (8) exerts a force on the part (P). (FIG.-1)

In an embodiment of the invention, the manufacturing system (1) comprises at least one support element (10) extending from the base (Z) towards the table (5), a connection point (11) at which the table is connected to the support element (10), at least one support leg (12) located on the forging element (6) and extending from the base (Z) to the forging surface (8), a pivot point (13) at which the forging surface (8) is connected to the support leg (12), wherein the control unit (7) enables the position of the forging surface (8) around the pivot point (13) and of the table (5) around the connection point (11) to be changed with respect to the base (Z) and thus ensures that the table (5) and the forging surface (8) stay almost completely opposite to each other. The table (5), the support element (10) and the connection point (11) make up the device (2). The forging surface (8), the support leg (12) and the pivot point (13) form the forging element (6).

In an embodiment of the invention, the control unit (7) enables the table (5) to be rotated around the connection point (11) so as to become perpendicular to the base (Z) and get positioned opposite the forging surface (8). The control unit (7) enables the table (5) to rotate around the connection point (11) so as to become perpendicular to the base (Z), such that it stays opposite the forging surface (8) which is located perpendicular to the base (Z).

In an embodiment of the invention, the manufacturing system (1) comprises at least a first transmission element (14) located on the table (5) and enabling a force exerted on it to be transferred, at least a second transmission element (15) located on the forging surface (10) and enabling a force exerted on it to be transferred, wherein when at least one of the table (5) and/or the forging surface (10) comes close to the other one by means of the sliding mechanism (12) and the part (P) stays between the table (5) and the forging surface (10), the control unit (7) enables the first transmission element (14) and the second transmission element (15) to be energized so that the force exerted on the part (P) is distributed evenly throughout the part (P). The fact that there is a spring on both the table (5) and the forging surface (8) provides the generation of a double-acting force on the part (P), thereby enabling the microstructure of the part (P) during its manufacture to be improved.

In an embodiment of the invention, the manufacturing system (1) comprises at least one table substrate (16) between the table (5) and the support element (10), enabling the first transmission element (14) to stay between the table (5) and itself, at least one first actuator (17) located in connection with the table substrate (16) and enabling the first transmission element (14) to exert force to the table (5) by being energized by the control unit (9), at least one forging substrate (18) between the forging surface (8) and the support leg (12), enabling the second transmission element (15) to stay between the forging surface (10) and itself, and at least one second actuator (19) located in connection with the forging substrate (18) and enabling the second transmission element (15) to exert force to the forging surface (10) by being energized by the control unit (7). The spring is compressed between the table (5) and the table substrate (16). The first transmission element (14) energized by means of the first actuator (17) on the table substrate (16), enables the force to be transferred to the part (P) on the table (5). The second transmission element (15) energized by means of the second actuator (19) on the forging substrate (18), enables the force to be transferred onto the part (P) through the forging surface (8). The spring is compressed between the forging substrate (18) and the forging surface (6).

In an embodiment of the invention, the forging surface (8) has mirror symmetry with respect to the table (5), thereby enabling the part (P) to stay between the table (5) and itself.

In an embodiment of the invention, the forging surface (8) has a larger cross-sectional area than the part (P), thereby enabling a force to be applied on almost the entirety of the part (P) at the same time. Thanks to the forging surface having a cross-sectional area larger than the cross-sectional area of the part (P), an area-based forging is applied instead of a spot-based forging.

In an embodiment of the invention, the manufacturing system (1) comprises a sensor (20) located on the forging surface (10) and transmitting to the control unit (7) that the forging surface (10) comes into contact with the part (P), thereby enabling the movement of the table (5) and the forging surface (8) on the sliding mechanism (9) to be stopped when the part (P) stays between the table (5) and the forging surface (8). Thanks to the sensor (20) located on the forging surface (8), it is determined whether the forging surface (8) is in contact with the part (P) and it is ensured that the forging element (6) is stopped to start the forging process.

In an embodiment of the invention, the manufacturing system (1) comprises a rotary element (21) located between the table substrate (18) and the support element (7), enabling the table (5) to rotate around its axis while the part (P) is manufactured on the table (5). The table (5) rotates around its axis so that the part (P) is manufactured by the metal additive manufacturing process.

In an embodiment of the invention, the control unit (9) enables the forging surface (10) to automatically exert force on the part (P) at user-determined layer number breaks. The forging process is carried out in breaks between the number of layers as predetermined by the user.

In an embodiment of the invention, the forging surface (8) is almost entirely form-fitting to the part (P) so that the part (P) is manufactured in layers such that the form of the first layer deposited on the table (5) will not change. If the first layer of the part (P) rises invariably, this means that the forging surface is manufactured in a form-fitting manner to the first layer.

In an embodiment of the invention, the part (P) is manufactured by a direct energy deposition method in the manufacturing system (1).

What is claimed is:

1. A manufacturing system (1) comprising:

a device (2) for performing metal additive manufacturing, a feeder (3) located on the device (2) and enabling a raw material (H) to be deposited, a heat source (4) located on the device (2) and enabling the raw material (H) from the feeder (3) to be melted, a table (5) enabling the raw material (H) to be processed thereon, a part (P) formed by melting and processing the raw material (H) on the table (5) by means of the heat source (4), a forging element (6) providing improvement in a micro- and/or macrostructure of the part (P) by exerting force on the part (P) under control of a user and/or automatically, a base (Z) on which the device (2) is located, a control unit (7) enabling a position of the table (5) to be changed with respect to the base (Z), a support element (10) extending from the base (Z) towards the table (5), a connection point (11) at which the table (5) is rotatably connected to the support element (10), a support leg (12) located on the forging element (6) and extending from the base (Z) to a forging surface (8), and a pivot point (13) at which the forging surface (8) is rotatably connected to the support leg (12), wherein the control unit (7) enables a position of the forging surface (8) around the pivot point (13) and of the table (5) around the connection point (11) to be changed with respect to the base (Z) and thus ensuring that the table (5) and the forging surface (8) remain opposite to each other; wherein the forging element (6) is located opposite the device (2) on the base (Z), the forging surface (8) being located on the forging element (6) and enabling the part (P) to be forged, a sliding mechanism (9) being located on the base (Z), enabling at least one of the device (5) and/or the forging element (6) to move close to the other one, and the control unit (7) enabling the table (5) to stay opposite the forging surface (8) by being rotated around the point at which it is connected to the device (2), and the forging element (6) to be moved by means of the sliding mechanism (9) so that the forging surface (8) exerts force on the part (P).

2. The manufacturing system (1) according to claim 1, wherein the control unit (7) enables the table (5) to be rotated around the connection point (11) so as to become perpendicular to the base (Z) and be positioned opposite the forging surface (8).

3. The manufacturing system (1) according to claim 1, comprising at least a first transmission element (14) located on the table (5) and enabling a force exerted on it to be transferred, at least a second transmission element (15) located on the forging surface 8 and enabling a force exerted on it to be transferred, wherein when at least one of the table (5) and/or the forging surface 8 comes close to the other one by means of the sliding mechanism 9 and the part (P) stays between the table (5) and the forging surface 8, the control unit (7) enables the first transmission element (14) and the second transmission element (15) to be energized so that the force exerted on the part (P) is distributed evenly throughout the part (P).

4. The manufacturing system (1) according to claim 3, comprising at least one table substrate (16) between the table (5) and the support element (10), enabling the first transmission element (14) to stay between the table (5) and itself, at least one first actuator (17) located in connection with the table substrate (16) and enabling the first transmission element (14) to exert force to the table (5) by being energized by the control unit (7), a forging substrate (18) between the forging surface (8) and the support leg (12), enabling the second transmission element (15) to stay between the forging surface 8 and itself, and at least one second actuator (19) located in connection with the forging substrate and enabling the second transmission element (15) to exert force to the forging surface 8 by being energized by the control unit (7).

5. The manufacturing system (1) according to claim 1, wherein the forging surface (8) has mirror symmetry with respect to the table (5), thereby enabling the part (P) to stay between the table (5) and itself.

6. The manufacturing system (1) according to claim 1, wherein the forging surface (8) has a larger cross-sectional area than the part (P), thereby enabling a force to be applied on the part (P) at the same time.

7. The manufacturing system (1) according to claim 1, comprising a sensor (20) located on the forging surface 8 and transmitting to the control unit (7) that the forging surface 8 comes into contact with the part (P), thereby enabling movement of the table (5) and the forging surface (8) on the sliding mechanism (9) to be stopped when the part (P) stays between the table (5) and the forging surface (8).

8. The manufacturing system (1) according to claim 4, comprising a rotary element (21) being located between the table substrate (18) and the support element 10, enabling the table (5) to rotate around its axis while a part (P) is manufactured on the table (5).

9. The manufacturing system (1) according to claim 1, wherein the control unit (7) enables the forging surface 8 to automatically exert force on the part (P) at user-determined layer number breaks.

10. The manufacturing system (1) according to claim 1, wherein the forging surface (8) is almost entirely formfitting to the part (P) so that the part (P) is manufactured in layers such that the form of a first layer deposited on the table (5) will not change.

11. The manufacturing system (1) according to claim 1, wherein the part (P) is manufactured by direct energy deposition.

12. A manufacturing system (1) comprising:

a device (2) for performing metal additive manufacturing, a feeder (3) located on the device (2) and enabling a raw material (H) to be deposited, a heat source (4) located on the device (2) and enabling the raw material (H) from the feeder (3) to be melted, a table (5) enabling the raw material (H) to be processed thereon, a part (P) formed by melting and processing the raw material (H) on the table (5) by means of the heat source (4), a forging element (6) providing improvement in a micro- and/or macrostructure of the part (P) by exerting force on the part (P) under control of a user and/or automatically, a base (Z) on which the device (2) is located, at least one control unit (7) enabling a position of the table (5) to be changed with respect to the base (Z), a first transmission element (14) located on the table (5) and enabling a force exerted on it to be transferred, a second transmission element (15) located on a forging surface (8) and enabling a force exerted on it to be transferred, wherein when at least one of the table (5) and/or the forging surface (8) comes close to the other one by means of a sliding mechanism (9) and the part (P) stays between the table (5) and the forging surface (8), the control unit (7) enables the first transmission element (14) and the second transmission element (15) to be energized so that the force exerted on the part (P) is distributed evenly throughout the part (P), a table substrate (16) between the table (5) and a support element (10), enabling the first transmission element (14) to stay between the table (5) and itself, a first actuator (17) located in connection with the table substrate (16) and enabling the first transmission element (14) to exert force to the table (5) by being energized by the control unit (7), a forging substrate (18) between the forging surface (8) and a support leg (12), enabling the second transmission element (15) to stay between the forging surface (8) and itself, and at least one second actuator (19) located in connection with the forging substrate and enabling the second transmission element (15) to exert a force to the forging surface (8) by being energized by the control unit (7), wherein the forging element (6) is located opposite the device (2) on the base (Z), the forging surface (8) being located on the forging element (6) and enabling the part (P) to be forged, the sliding mechanism (9) being located on the base (Z), enabling at least one of the device (5) and/or the forging element (6) to move close to the other one, and the control unit (7) enabling the table (5) to stay opposite the forging surface (8) by being rotated around a point at which it is connected to the device (2), and the forging element (6) to be moved by means of the sliding mechanism (9) so that the forging surface (8) exerts force on the part (P).

* * * * *